US011388976B2

(12) United States Patent
Espeland

(10) Patent No.: US 11,388,976 B2
(45) Date of Patent: Jul. 19, 2022

(54) BACKPACK WITH A HORIZONTAL HYDRATION RESERVOIR

(71) Applicant: Jon Erik Espeland, Ridgefield, CT (US)

(72) Inventor: Jon Erik Espeland, Ridgefield, CT (US)

( * ) Notice: Subject to any disclaimer, the term of this patent is extended or adjusted under 35 U.S.C. 154(b) by 0 days.

(21) Appl. No.: 16/847,099

(22) Filed: Apr. 13, 2020

(65) Prior Publication Data

US 2020/0329851 A1 Oct. 22, 2020

Related U.S. Application Data

(60) Provisional application No. 62/836,645, filed on Apr. 20, 2019.

(51) Int. Cl.
*A45F 3/16* (2006.01)
*A45F 3/04* (2006.01)

(52) U.S. Cl.
CPC ..... *A45F 3/16* (2013.01); *A45F 3/04* (2013.01); *A45F 2003/166* (2013.01)

(58) Field of Classification Search
CPC ..... A45F 2003/166; A45F 3/16; A45F 3/04; A45F 2003/148; A45F 2003/146; A45F 3/20; A45F 2003/003; A45F 2200/0583; A45F 3/047; A45F 3/14; A45C 13/008; Y10S 383/906; A41D 2400/46
USPC ..... 224/148.2, 148.1–148.7
See application file for complete search history.

(56) References Cited

U.S. PATENT DOCUMENTS 7,820,946 B2 * 10/2010 Woodfill ..... A45F 3/04 219/214
2010/0237122 A1 * 9/2010 Toledo ..... A45F 3/04 224/638
2015/0342326 A1 * 12/2015 Drysdale ..... A61F 7/02 224/148.5
2016/0113379 A1 * 4/2016 Marui ..... A45F 3/18 224/148.1

FOREIGN PATENT DOCUMENTS

WO WO-2006020593 A1 * 2/2006 ..... A45F 3/04
WO WO-2011003110 A2 * 1/2011 ..... A45F 3/04

* cited by examiner

*Primary Examiner* — Nathan J Newhouse
*Assistant Examiner* — Matthew T Theis
(74) *Attorney, Agent, or Firm* — DunLap Bennett & Ludwig, PLLC

(57) ABSTRACT

A backpack and horizontal hydration reservoir combination is provided. The backpack does not extend downward beyond the middle of the back of the wearer, thereby eliminating the need for long shoulder straps and maintaining the weight of the hydration reservoir, housed within the backpack, in a horizontal orientation above the middle of the back.

6 Claims, 4 Drawing Sheets

BACKPACK WITH A HORIZONTAL HYDRATION RESERVOIR

CROSS-REFERENCE TO RELATED APPLICATION

This application claims the benefit of priority of U.S. provisional application No. 62/836,645, filed 20 Apr. 2019, the contents of which are herein incorporated by reference.

BACKGROUND OF THE INVENTION

The present invention relates to backpacks and, more particularly, to a backpack with a horizontal hydration reservoir.

Backpacks designed to accommodate vertical hydration reservoirs result in a lower center of gravity, pulling the user backwards causing a backwards lean or an overcompensation of leaning far forward. The backward or extreme forward lean results in slower and less balanced hiking, running, or other physical activity.

Moreover, backpacks with vertical hydration reservoirs slide around due to the loose-fitting nature of the longer shoulder straps inherent in vertical hydration reservoir backpack systems. As a result, the loose-fitting shoulder straps result in the backpack not moving in sync with the user. In addition, backpacks that are made from waterproof material that are not breathable, do not allow wet items in the backpack to dry while it is being used.

As can be seen, there is a need for a backpack with a horizontal hydration reservoir. Optimal running form is between straight upright and an eight-degree forward lean, and the higher center of gravity of a horizontal-hydration-reservoir backpack system allows the user to run or hike with optimal form. Moreover, the shoulder straps are shorter in a horizontal-hydration-reservoir backpack system when properly adjusted resulting in the backpack moving more in sync with the user.

The present invention provides a horizontal hydration reservoir resulting in a higher center of gravity and close-fitting shoulder straps which allows the user to stand upright or lean slightly forward, and thus have the backpack move more in sync with the user, especially when jogging or hiking. The backpack is designed to be positioned at the top half of the user's back and is either as wide as it is tall or wider than it is tall, depending on the size. It also has a compartment for the horizontal hydration reservoir to be stowed horizontally.

The backpack is also made from waterproof yet breathable fabric allowing either liquid spilled in the backpack while refilling or wet items such as jackets or bathing suits to dry while it is being worn.

SUMMARY OF THE INVENTION

In one aspect of the present invention, the backpack dimensioned to provide a hydration reservoir and facilitate a running form between straight upright and an eight-degree forward lean, the backpack extending between an upper portion and a lower portion, wherein the lower portion is adapted to be located above a wearer's middle back when said backpack is worn.

In another aspect of the present invention, the backpack further includes the following: the hydration reservoir having a width equal to or greater than a height; the backpack defined by an inner panel and outer panel, the inner panel providing a reservoir hanger for removably engaging the hydration reservoir thereto; one or more divider panels between the hydration reservoir and the outer panel, defining a storage compartment between the hydration reservoir and the outer panel; a detachable fastener in an upper portion of the outer panel adjacent for accessing the storage compartment; a panel opening in at least one of the one or more divider panels, wherein the panel opening is adjacent the detachable fastener, whereby the hydration reservoir is removably from the reservoir hanger and through the panel opening and an opening defined by the detachable fastener; the outer panel and the one or more divider panels made from waterproof and breathable fabric; a concave neck joint joining interconnecting the inner panel and the outer panel at the upper portion of the backpack; a bidirectional guide loop attached to the upper portion of the backpack adjacent the concave neck joint; and a tubing extending from a lower portion of the hydration reservoir and through the bidirectional guide loop.

These and other features, aspects and advantages of the present invention will become better understood with reference to the following drawings, description and claims.

DETAILED DESCRIPTION OF THE INVENTION

Figure 1:
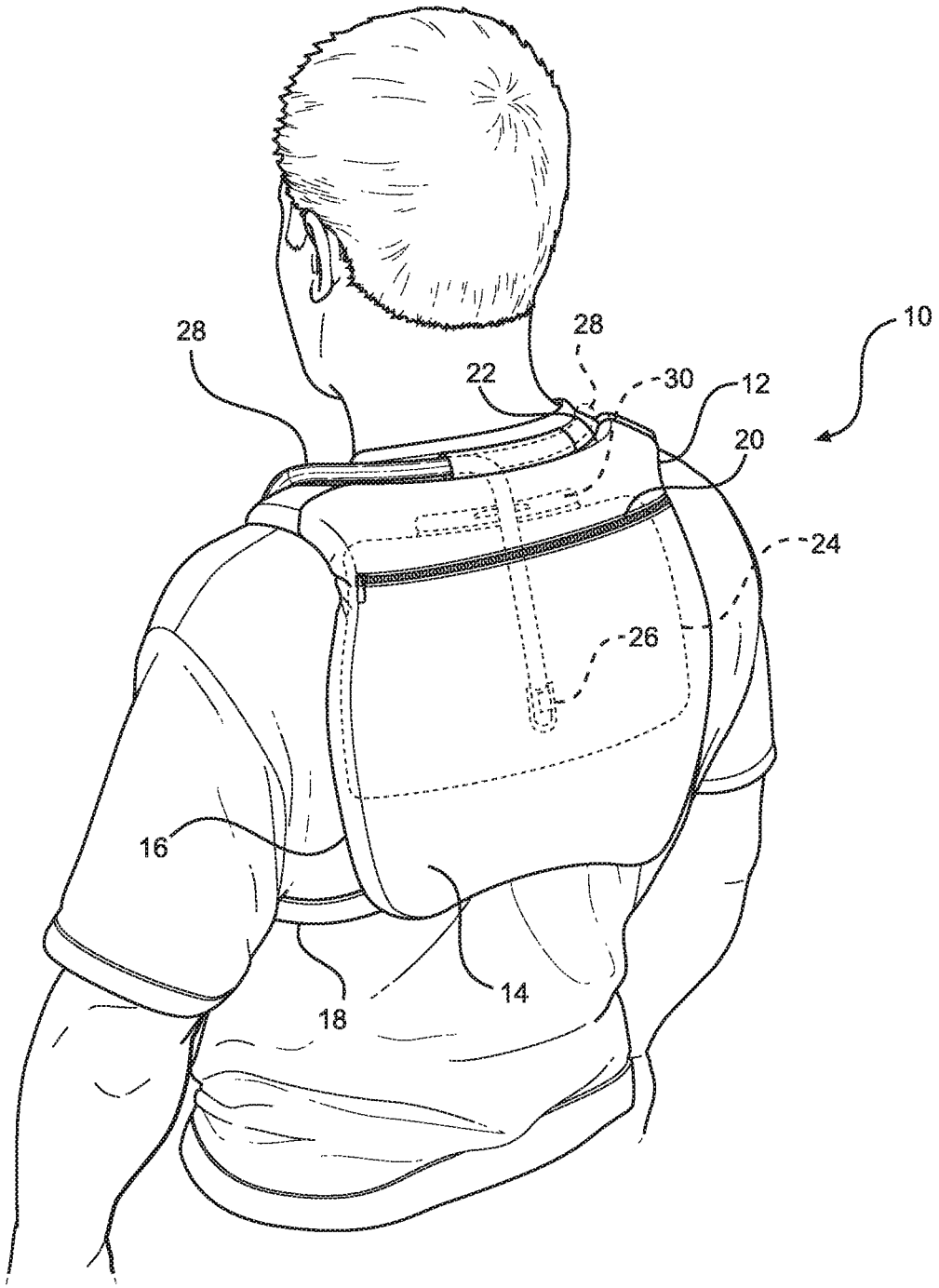
FIG. 1 is a rear elevation view of an exemplary embodiment of the present invention, illustrating how an upper portion of the backpack has a curvature dimensioned and adapted to be adjacent to the superior fibers of a wearer's trapezius.
Figure 2:
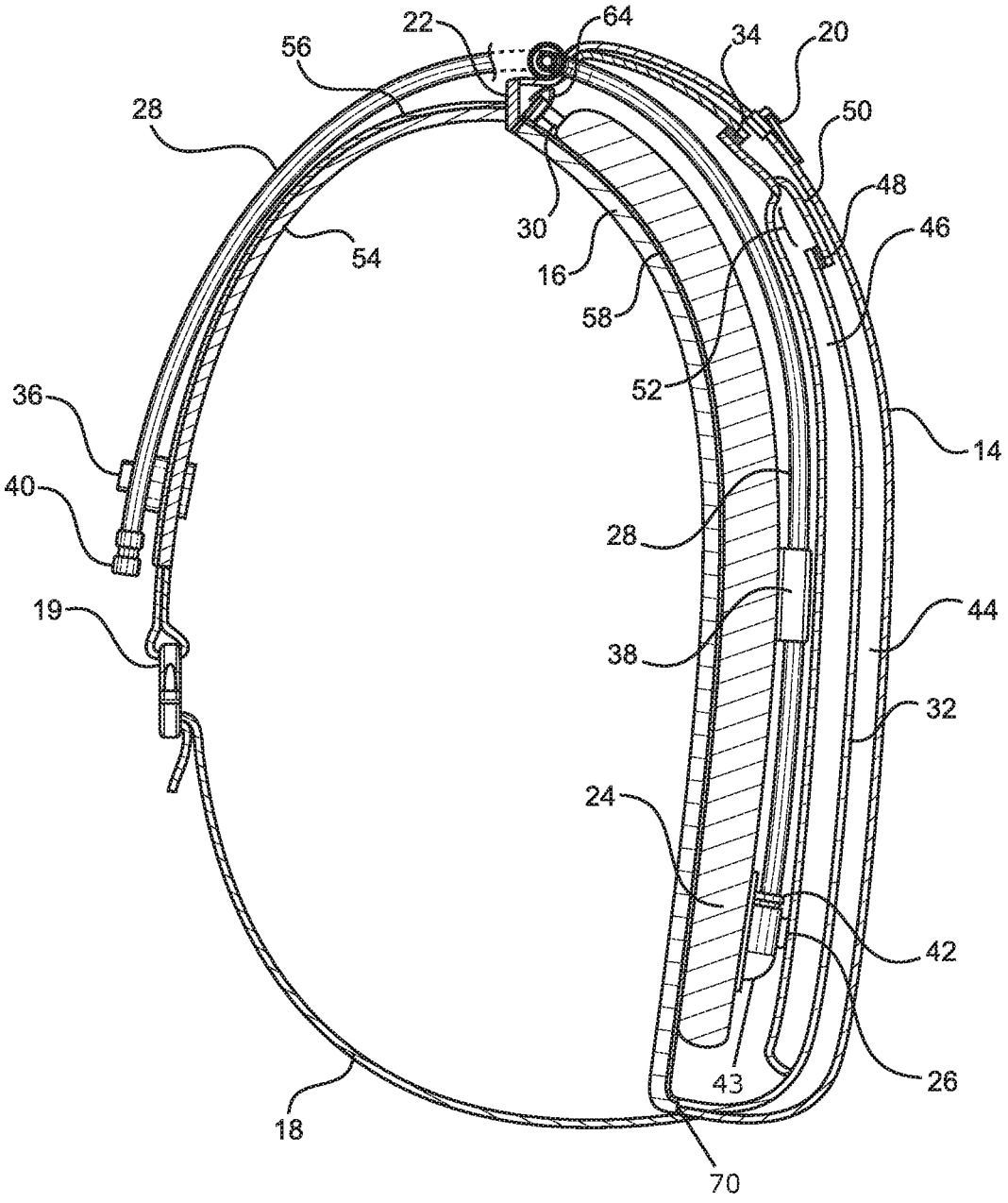
FIG. 2 is a cross section view of an exemplary embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a backpack and horizontal hydration reservoir combination wherein the backpack does not extend downward beyond the middle of the back of the wearer, thereby eliminating the need for long shoulder straps and maintaining the weight of the hydration reservoir above the middle of the back.

It should be understood by those skilled in the art that the use of directional terms such as upper, upward, top, lower, downward, bottom, inner, outer and the like are used in relation to the illustrative embodiments as they are depicted in the figures: the upward direction (or upper) being toward the top of the corresponding figures; the downward direction being toward the bottom of the corresponding figures; and the inner direction being adjacent an user's back when worn.

Referring to FIGS. 1 through 4, the present invention may include a backpack and horizontal hydration reservoir combination 10. The backpack and horizontal hydration reservoir combination 10 includes the backpack 12 defined by an outer panel 14, and inner panel 58 and a concave neck joint 22. Along an upper portion of the backpack 12 the concave neck joint 22 interconnects upper portions of the outer and inner panels 14 and 58. Along a lower portion of the backpack 12 the lower portions of the outer and inner panels 14 and 58 join at a lower interface 70. At least the outer panel 14 may be made of both waterproof and breathable fabric for the reason stated above.

At the lower interface 70, one or more divider panels 32 may extend upward adjacent the outer panel 14, thereby defining an integral accessories pouch 46. The integral accessories pouch 46 may provide an opening 52 accessible by moving a flap 50 between an open position before returning it to a closed position removably locked by way of a pouch closure 48, which in certain embodiments is a hook and loop fastener. Between the integral accessories pouch 46 and the outer panel 14 a storage compartment 44 may be defined. A detachable fastener 20, such as a zipper, along the outer panel provides access to the storage compartment 44. Attached along the inner panel 58 by way of threading 62 or other suitable joining techniques may be a mesh material 16.

Between the inner panel 58 and the one or more divider panel 32 is housed a removably horizontal reservoir 24. The horizontal reservoir 24 may be supported by a hanger 30 fixed along an inner surface of the upper portion of the inner panel 58. The removably attachment of the horizontal reservoir 24 to the fixed hanger 30 may be enabled by a removably fastener 64, in certain embodiments a hook and loop fastener.

Figure 3:
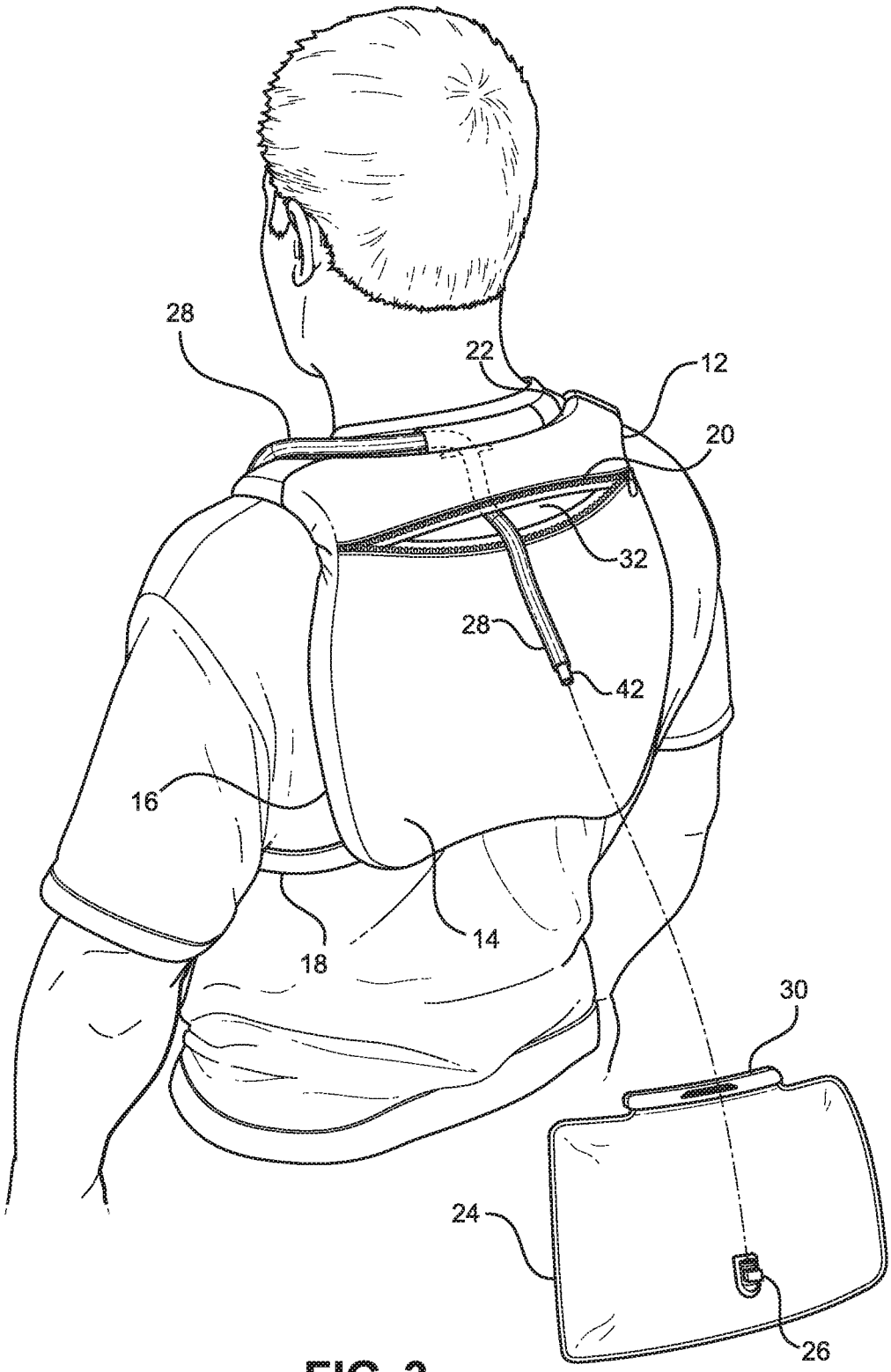
FIG. 3 is an exploded perspective view of an exemplary embodiment of the present invention, illustrating the reservoir detached.
Figure 4:
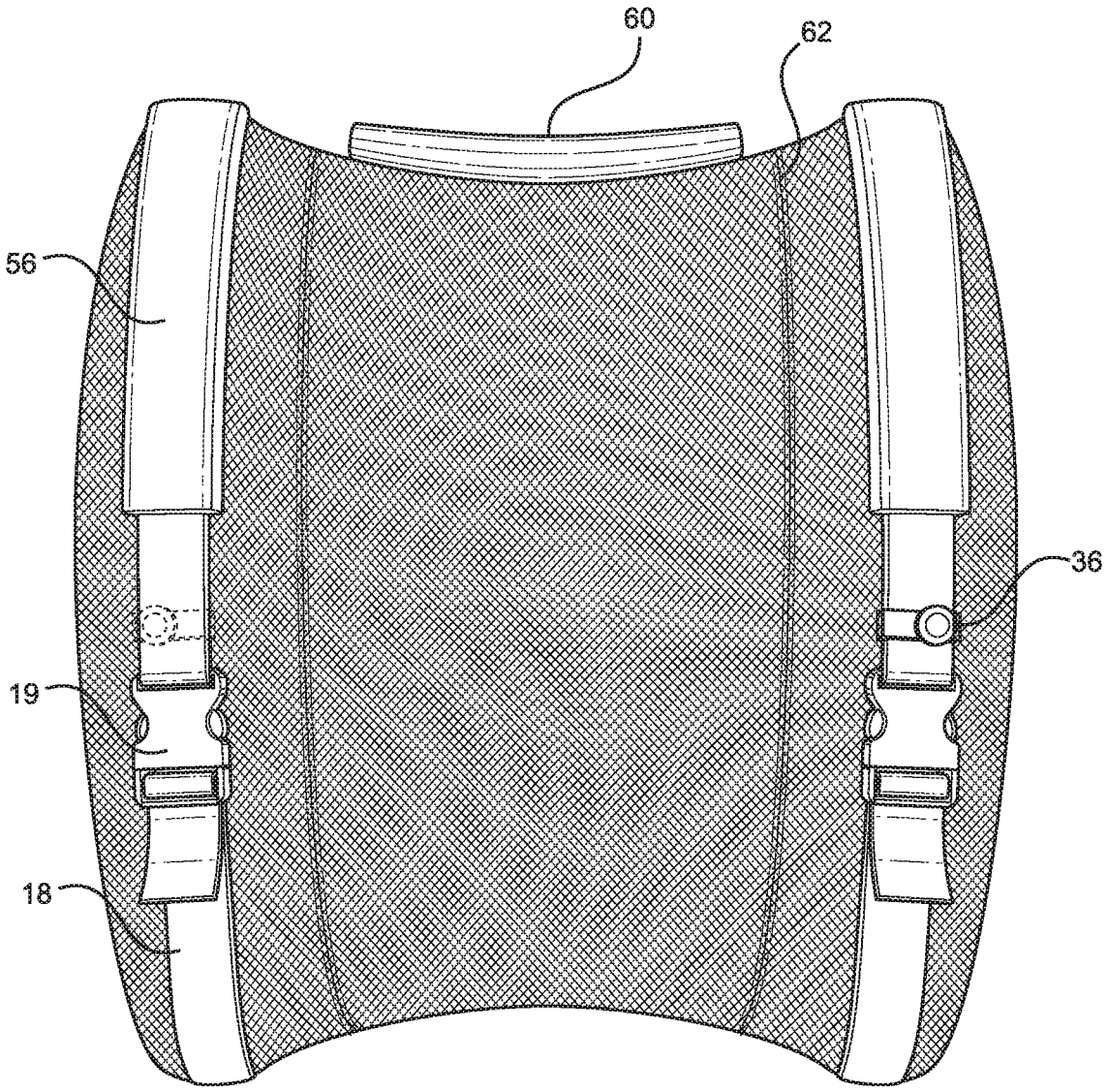
FIG. 4 is a front elevation view of an exemplary embodiment of the present invention, demonstrating an operative effect.

The one or more divider panels 32 may extend to the upper portion of the outer panel 14 except for a void adjacent the upper portion of the outer panel, the void can be opened and closed off by a removably fastener 34. Thereby, a user who wanted to remove or replace the removably horizontal reservoir 24, as illustrated in FIG. 3, could do so through the void created by moving the removable fastener 34 to an open condition, while not disturbing the integral accessories pouch 46.

Fluidly coupled to the horizontal reservoir 24 is tubing 28 by way of an inlet/outlet structure 42. The inlet/outlet connector 42 may engage an inlet/outlet structure 43 be along a lower portion of the horizontal reservoir 24. The inlet/outlet structure 43 fluidly connects to the bottom of the horizontal reservoir 24 to maximize access to a fluid housed in the horizontal reservoir 24 when the present invention is being used. The connector 26 is a button that can be pressed to join inlet/outlet 42 in inlet/outlet structure 43. When the button is released, the two cannot be separated. When the button is pressed again, it allows for the two parts to be disconnected. The tubing 28 may be clipped to the horizontal reservoir 24 near midpoint thereof by way of a reservoir tubing clip 38 before continuing through an opening in the upper portion of the outer panel 14, adjacent the concave neck joint 22, and into and through a bidirectional guide loop 60 and terminating outside of the backpack 12 with a removable cap 40.

Extending from the upper portion of the backpack 12 are two shoulder straps 54 having an exterior strap panel 56, wherein the distal end of each shoulder straps 54 provide removably connector 19, such as a buckle, to removably and adjustably engage distal ends of lower straps 18 extending from the lower portion of the backpack 12. Along each exterior strap panel 56 may be a strap tubing clip 36 for restraining the distal end of the tubing 28.

Each shoulder strap 54 and lower strap 18 is extendable at the connector 19 to be long when putting on the backpack 12, and then pulled snug for a close-fitting shoulder strap profile. The hydration reservoir 24 can be taken in and out of the backpack 12 without the tubing 28, which can be connected/disconnected at the inlet/outlet connector 42. The reservoir 24 can be filled with liquids such as water or sports drink or soda. And, the reservoir 24 can be stowed in the compartment behind the divider panel 32. The liquid can be urged by the user through the tubing 28 connected to the reservoir 24. The tubing 28 can be routed to the left or right leaving the backpack 12 at the bidirectional guide loop 60. The end of the tubing can be quickly secured to either shoulder strap using a clasp and magnet strap tubing clip 36. The backpack 12 can be removed by unbuckling one of the connectors 19 and sliding the backpack down the opposite arm or unbuckling both connectors 19.

The backpack 12 is dimensioned and adapted to cover only the user's top half of their back and wide enough to accommodate a 2-liter to 3-liter horizontal reservoir 24.

The order of the compartments could be switched. The compartment that holds the reservoir could be the top compartment and the one closest to the user's back could be the storage compartment 44 for supplies. This design, however, is inferior for two (2) reasons: (1) since water is heavy/dense relative to the other items or supplies housed by the storage compartment 44, it should be closest to one's back to create the least amount of leverage making the backpack 12 feel as light as possible; and (2) the reservoir 24, especially when filled with water, acts as a buffer between the user's back and items in the top storage compartment 44.

Also, the location of the integral accessory pouch 46 can be moved, especially is dimensioned for toting a smart device. The type of fasteners used could be interchanged between zippers, snaps, hook and loop. The type of fabric could be switched—instead of using waterproof and breathable fabric, just waterproof fabric could be used.

A method of using the present invention may include the following. The backpack and horizontal hydration reservoir combination 10 disclosed above may be provided. The backpack 12 can be worn on a day hike, running on pavement or on a trail, riding on a bicycle, etc. and keep the user hydrated, energized with nutrients and not interfere in the athletic activity due to physical encumbrance or overall leveraged weight.

It should be understood, of course, that the foregoing relates to exemplary embodiments of the invention and that modifications may be made without departing from the spirit and scope of the invention as set forth in the following claims.

What is claimed is:

1. A backpack comprising:

an inner panel extending between an upper portion and a lower portion, wherein the upper portion has a curvature dimensioned and adapted to be adjacent to superior fibers of a wearer's trapezius, and wherein the lower portion is adapted to be located above a middle portion of the wearer's back;

a hydration reservoir having a width greater than a height, wherein the inner panel provides a reservoir hanger for removably engaging the hydration reservoir thereto;

a concave neck joint joining interconnecting the inner panel and the outer panel at the upper portion of the backpack;

a bidirectional guide loop attached to an external portion of the backpack;

and opening through the outer panel said opening communicates with a central portion of the bidirectional guide loop; and a tubing extending from a lower portion of the hydration reservoir and through said opening and the bidirectional guide loop.

2. The backpack of claim 1, further comprising:

one or more divider panels between the hydration reservoir and the outer panel, defining a storage compartment between the hydration reservoir and the outer panel; and a detachable fastener in an upper portion of the outer panel adjacent for accessing the storage compartment.

3. The backpack of claim 2, further comprising:

a panel opening in at least one of the one or more divider panels, wherein the panel opening is adjacent the detachable fastener, whereby the hydration reservoir is removably from the reservoir hanger and through the panel opening and an opening defined by the detachable fastener.

4. The backpack of claim 3, further comprising:

the outer panel and the one or more divider panels made from waterproof and breathable fabric.

5. The backpack of claim 1, further comprising:

two shoulder straps extending from the upper portion of the backpack;

a buckle at a distal end of each shoulder strap; and two lower straps extending from the lower portion of the backpack.

6. The backpack of claim 5, wherein the backpack has two opposing convex sides, whereby the two opposing convex sides are adjacent the wearer's shoulder blades facilitating a running form between straight upright and an eight-degree forward lean.

* * * * *